US006672891B2

(12) United States Patent
Xie

(10) Patent No.: US 6,672,891 B2
(45) Date of Patent: Jan. 6, 2004

(54) ZERO INSERTION FORCE CONNECTOR FOR SUBSTRATES WITH EDGE CONTACTS

(75) Inventor: Hong Xie, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/967,060

(22) Filed: Sep. 28, 2001

(65) Prior Publication Data

US 2003/0064617 A1 Apr. 3, 2003

(51) Int. Cl.[7] ..... H01R 13/62; H01R 11/22
(52) U.S. Cl. ..... 439/260; 439/266
(58) Field of Search ..... 439/259, 260, 439/66, 325, 342, 266

(56) References Cited

U.S. PATENT DOCUMENTS 4,542,950 A * 9/1985 Gillett et al. ..... 439/259
5,795,171 A * 8/1998 Bernardini ..... 439/260
5,795,172 A * 8/1998 Shahriari et al. ..... 439/260
6,250,933 B1 * 6/2001 Khoury et al. ..... 324/754
6,371,781 B1 * 4/2002 Jones et al. ..... 439/260

* cited by examiner

*Primary Examiner*—Chandrika Prasad
(74) *Attorney, Agent, or Firm*—Kenyon & Kenyon

(57) ABSTRACT

A device and method are for increasing the normal force on a substrate power connector. The device includes an edge-type substrate, a socket housing and an actuator. The socket housing receives the edge-type substrate with a zero insertion force or a low insertion force, and the actuator increases a normal force between the socket housing and the substrate to electrically couple the socket and the substrate. A method of creating a power connection includes inserting an edge-type substrate into a socket housing and activating an actuator to increase a normal force between the socket the substrate.

22 Claims, 1 Drawing Sheet

ZERO INSERTION FORCE CONNECTOR FOR SUBSTRATES WITH EDGE CONTACTS

FIELD OF THE INVENTION

The present invention relates to a power connector for a substrate. More specifically, the present invention relates to a zero insertion force power connector for a substrate with an edge-type connector. The present invention further relates to a method for creating a power connection for a substrate and, more specifically, a method of using a zero insertion force socket by actuating an actuator to increase the normal force between the substrate metal contacts and the socket contacts.

BACKGROUND INFORMATION

Edge-type power connections are commonly used for integrated circuits. These connections often consist of the edge of the substrate upon which an integrated circuit is etched, deposited or otherwise arranged. The substrate may have an organic composition and is generally planar. The substrate may be both flexible, with respect to bending or breaking forces, and rigid, with respect to compressive loads. Arranged on an edge of the substrate may be a metal contact area. This metal contact area may consist of a zone of metal plating on the surface of the substrate extending along the edge of the substrate. Alternatively, this metal zone may be situated on both sides of one edge of the substrate. This metal contact area is connected to the integrated circuit and provides power for the circuit. The electrical contact on one side of the substrate may be electrically coupled to the electrical contact on the other side of the substrate. Such a substrate with edge contacts may be referred to as an edge-type substrate.

Power connections generally use a contact design in which a socket contact, or numerous socket contacts, engage a substrate metal contact, or numerous metal contacts, with some insertion force. Within the socket (socket housing), there may be spring loaded contacts (socket contacts) or fingers (socket fingers) that contact the metal pads (metal contacts) of the substrate to provide power delivery to the substrate. When the socket engages the substrate, the socket fingers are deformed, and an insertion force must be applied to the substrate in order to push the substrate further into the socket to overcome the resistance imposed by the deformation of the socket fingers. When the substrate bottoms out in the socket, the socket fingers reach their final positions. The deformation of the socket fingers provides a normal force between the substrate and the socket that reduces the DC resistance of the power connection. The DC resistance is the resistance of the system to a direct current as motivated by a constant voltage.

In certain substrate edge power delivery solutions, when the package edge connector is inserted into the socket, the contacts resist the substrate movement, thus creating an insertion force. This insertion force can bend or even break the substrate, thus damaging the integrated circuit. Since the insertion force is limited by the substrate mechanical strength, which is often limited by the integrated circuit manufacturing process, the normal force of the connector is also limited. Therefore, traditional edge type power connectors are limited in their ability to reduce the DC resistance at the contacts between the substrate and the socket.

A conventional power connection is illustrated in FIGS. 1A and 1B. FIG. 1A illustrates a substrate 101 with an integrated circuit having metal contacts 102 on both sides of an edge to provide power to the integrated circuit. Two socket contacts 104, also referred to as socket fingers, are enclosed within socket 103. Socket contacts 104 are arranged in opposition to each other within socket 103. Additional socket contacts may be situated adjacent to socket contacts 104, such that a line of socket contacts extends on both sides of socket 103, the two lines extending parallel to the opening of the socket and the edge of substrate 101. The gap between socket contacts 104 is smaller than the width of substrate 101. Therefore, an amount of force is required to insert substrate 101 into socket 103 when moving substrate 101 in the direction of arrow 105. As metal contacts 102 on substrate 101 pass between socket contacts 104, socket contacts 104 are deformed slightly since substrate 101 is not easily compressible. Therefore, as substrate 101 is pushed into socket 103, socket contacts 104 are deformed outwardly. The deformation of socket contacts 104 provides a normal force in the power connection between socket contacts 104 and metal contacts 102.

FIG. 1B illustrates substrate 101 completely inserted into socket 103. Socket contacts 104 have deformed slightly to allow passage of substrate 101 that includes metal contacts 102. Socket contacts 104 resist deformation and therefore resist insertion of substrate 101. Due to the limited rigidity of substrate 101, the amount of deformation and resistance is therefore also limited. Thus, if the deformation, and therefore the resistance, is increased beyond a certain limit, substrate 101 may bend and/or break in response to the resistance to insertion imposed by socket contacts 104 when substrate 101 is inserted into socket 103. This limitation on the deformation of socket contacts 104 translates into a limitation on the normal force between socket contacts 104 and metal contacts 102.

Zero insertion force (ZIF) connectors for pins have been utilized to increase the normal force on the pin and thereby decrease resistance to the signal being transmitted through the pin connector. ZIF pin connectors have included rings as the connectors for the pins. After insertion of the pin into the socket, actuation may either close the ring around the pin or move the pin against the substantially stationary ring. Increased normal force for pin connectors may lower DC resistance for a signal, which may result in a better signal to noise ratio.

An object of the present invention is to provide a zero insertion force power connector for edge-type substrates, and to thereby decrease the mechanical strength requirements of the substrate and decrease the resistance, and therefore the power loss, in the power connection.

DETAILED DESCRIPTION

Figure 1A:
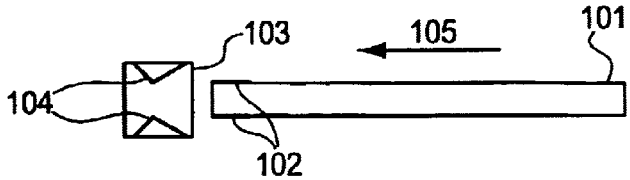
Fig 1A Prior Art
FIG. 1A is a schematic side view of a prior art socket showing a substrate and a socket prior to the substrate being inserted into the socket.
Figure 1B:
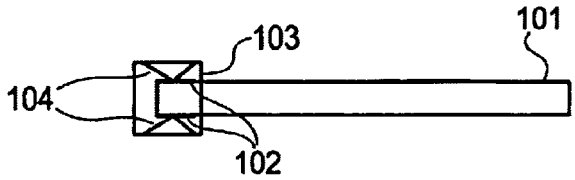
Fig 1B Prior Art
FIG. 1B is a schematic side view of the prior art socket illustrated in FIG. 1A showing the substrate and the socket after the substrate has been inserted into the socket.
Figure 2A:
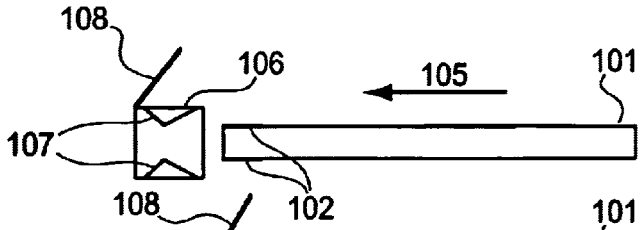
FIG. 2A is a schematic side view of an example embodiment of a connector according to the present invention showing a substrate and a socket prior to the substrate being inserted into the socket and showing an actuation arm on the socket in an unactuated position.
Figure 2B:
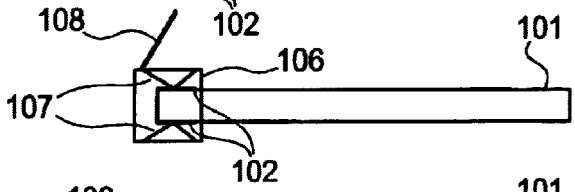
FIG. 2B is a schematic side view of the connector illustrated in FIG. 2A showing the substrate and the socket after the substrate has been inserted into the socket and showing the actuation arm on the socket in the unactuated position.
Figure 2C:
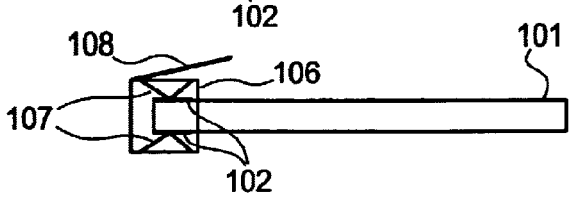
FIG. 2C is a schematic side view of the connector illustrated in FIGS. 2A and 2B showing the substrate and the socket after the substrate has been inserted into the socket and showing the actuation arm in an actuated position.

An example embodiment of a connector according to the present invention is illustrated schematically in FIGS. 2A to 2C. Substrate 101 (an edge-type substrate, also known as a substrate with edge contacts) may be at least partially composed of silicon and may be provided with an integrated circuit or other component. Substrate 101 includes metal contacts 102 on both sides of an edge to provide power to the component. Two socket contacts 107, also referred to as socket fingers, are enclosed within socket 106. Socket 106 also includes a lever 108, shown in FIG. 2A in an unactuated position. Socket contacts 107 are arranged in opposition to each other within socket 106. Additional socket contacts may be arranged adjacent to socket contacts 107, such that a line of socket contacts extends on both sides of socket 106, the two lines extending parallel to the opening of socket 106 and the edge of substrate 101. In contrast to the connector illustrated in FIGS. 1A and 1B, the width gap between socket contacts 107 as illustrated in FIGS. 2A to 2C is substantially the same as the width of substrate 101. Because the width of the gap between socket contacts 107 is substantially the width of substrate 101, little, if any, force is required to insert substrate 101 into socket 106 while the substrate is being moved in the direction of arrow 105.

FIG. 2B illustrates substrate 101 fully inserted into socket 106 but prior to actuation of lever 108. Socket contacts 107 may or may not contact metal contacts 102 when substrate 101 is fully inserted into socket 106. Socket contacts 107 do not deform, or are not substantially deformed, when substrate 101 is inserted into socket 106. The normal force between socket contacts 107 and metal contacts 102 is small or zero prior to actuation of lever 108 on socket 106.

FIG. 2C illustrates lever 108 in an actuated position, in contrast to FIGS. 2A and 2B, which illustrate lever 108 in an unactuated position. Actuating lever 108 may, for example, be configured to move both socket contacts 107 towards substrate 101. Alternatively, actuating lever 108 may be configured to move one socket contact 107, arranged on one side of socket 106 (i.e., the socket contact 107 illustrated on the top in FIGS. 2A, 2B and 2C or, alternatively, the socket contact 107 on the bottom in FIGS. 2A, 2B and 2C), as well as any additional socket contacts arranged on the same side of socket 106 toward movable substrate 101. In this alternative, the socket contacts 107 that are arranged opposite to the socket contacts 107 may remain substantially stationary or immovable. Therefore, actuation of the lever 108 increases the normal force between socket contacts 107 and metal contacts 102, thereby decreasing the DC resistance between socket contacts 107 and metal contacts 102.

Figure 3A:
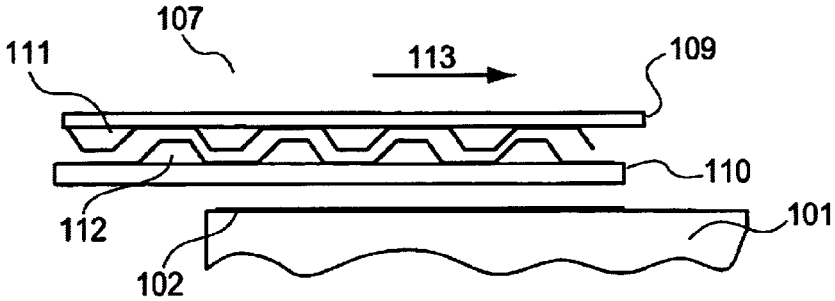
FIG. 3A is a partial schematic side view of another example embodiment of a socket connector according to the present invention prior to actuation.

FIG. 3A illustrates an example embodiment of the edge-type power connector according to the present invention. FIG. 3A specifically illustrates a socket contact 107 including a movable socket part 109 and a spring contact 110 prior to actuation of an actuator. Movable socket part 109 is configured to be actuated by the actuator, which may include an arm, handle, lever, any other actuating device or combination thereof. Movable socket part 109 moves in the direction of arrow 113 when actuated by the actuator. Spring contact 110 is configured to contact metal contacts 102 on the substrate 101 on a side opposite that of movable socket part 109. Spring contact 110 is configured to be substantially immovable in the direction of arrow 113 and the reverse direction of arrow 113. Movable socket part 109 includes a series of bumps 111 on a side adjacent to spring contact 110. Likewise, spring contact 110 includes a series of bumps 112 on a side adjacent to movable socket part 109. In the unactuated or rest position illustrated in FIG. 3A, bumps 111 and 112 together form a zig-zag pattern and exert little or no force against each other. Each of bumps 111 and 112 includes a sloped edge such that, when movable socket part 109 is actuated to move in the direction of arrow 113 (for example, when the substrate 101 has been inserted into the socket), each bump 111 interacts with a corresponding bump 112 to urge movable socket part 109 away from spring contact 110.

Figure 3B:
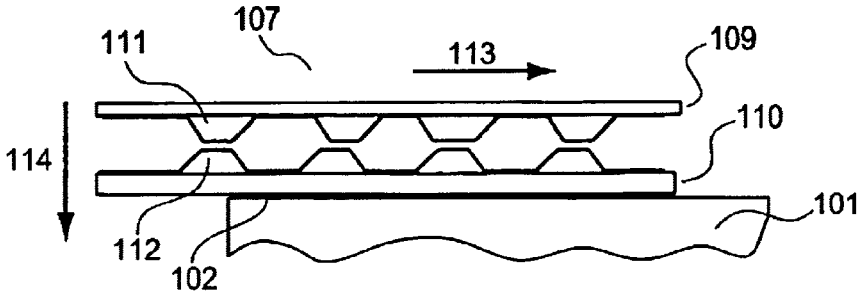
FIG. 3B is a partial schematic side view of the socket connector illustrated in FIG. 3A showing the one side of the socket connector after actuation.

FIG. 3B illustrates the edge-type power connector illustrated in FIG. 3A after actuation of the actuator. That is, FIG. 3B illustrates the edge-type power connector in the actuated position. Movable socket part 109 is substantially immovable in the direction of arrow 114 and the reverse direction of arrow 114, while spring contact 110 is movable in the direction of arrow 114 and the reverse direction of arrow 114. By actuating the actuator, movable socket part 109 moves in the direction of arrow 113, forcing bumps 111 and 112 to interact. The interaction of bumps 111 with corresponding bumps 112, and specifically the sloped edges of both bumps 111 and 112, causes the separation of movable socket part 109 and spring contact 110. Since movable socket part 109 is immovable in the direction of arrow 114 and the reverse direction of arrow 114, actuation of the actuator causes spring contact 110 to move in the direction of arrow 114. This movement of spring contact 110 is against the substrate 101 when the substrate 101 is inserted in the socket. Specifically, this movement of spring contact 110 translates into a normal force against the metal contacts 102 on the substrate 101. So long as the substrate 101 is constrained from moving away from the spring contact 110 (i.e., the substrate 101 is limited in its ability to move in the direction of arrow 114), the normal force between spring contact 110 and the metal contacts 102 is increased by actuation of the socket. The substrate IQI may be constrained against movement in the direction of arrow 114 by, for example, either a rigid barrier or an arrangement similar to that illustrated in FIGS. 3A and 3B arranged on the opposite side of the socket. The opposite arrangement may be provided on the other side of the substrate 101 but oriented so that actuation of the actuator causes an opposite spring contact to move in a reverse direction of arrow 114.

What is claimed is:

1. An apparatus, comprising:

a substrate including a first surface, a second surface opposite the first surface, and a plurality of electrical contacts applied to at least one of the first surface and the second surface, the plurality of electrical contacts arranged on an edge of the at least one of the first surface and the second surface;

a socket housing configured to receive the substrate and, on each side of the socket housing corresponding to the at least one of the first surface and the second surface having electrical contacts applied thereto, including a corresponding number of socket contacts, each of the socket contacts configured to electrically couple to a respective electrical contact, the socket contacts on each side arranged substantially in a plane; and an actuator configured to increase a normal force between the socket contacts and the plurality of electrical contacts;

wherein at least one socket contact includes:

a movable socket part including at least one first bump; and a spring contact including at least one second bump, each second bump corresponding to a respective one of the first bumps, each corresponding pair of first and second bumps configured to urge against each other to increase the normal force in accordance with actuation of the actuator.

2. The apparatus according to claim 1, wherein the substrate is insertable into the socket housing with a substantially zero insertion force.

3. The apparatus according to claim 1, wherein the substrate is at least partially composed of silicon.

4. The apparatus according to claim 1, wherein:

the substrate includes two electrical contacts; and the socket housing includes two socket contacts.

5. The apparatus according to claim 1, wherein:

the substrate includes a first electrical contact arranged on the first surface and a second electrical contact arranged on the second surface; and the socket housing includes:

a first socket contact configured to electrically couple to the first electrical contact when the substrate is received in the socket housing; and a second socket contact in an opposed parallel relationship with the first socket contact, the second socket contact configured to electrically couple to the second electrical contact when the substrate is received in the socket housing.

6. The apparatus according to claim 5, wherein the first electrical contact and the second electrical contact are electrically coupled.

7. The apparatus according to claim 1, further comprising at least one spring device configured to urge each corresponding pair of first and second bumps against each other to thereby increase the normal force in accordance with actuation of the actuator.

8. The apparatus according to claim 1, wherein the first and second bumps are adapted by size and configuration so that each corresponding pair of first and second bumps is urged against each other to thereby increase the normal force by a relative movement between the movable socket part and the spring contact in accordance with actuation of the actuator.

9. The apparatus according to claim 8, wherein:

each of the bumps includes a sloped edge; and the bumps are arranged in a zig-zag pattern in a rest position and are aligned in an actuated position.

10. A device, comprising:

a socket housing adapted to receive a substrate, the socket housing including, on each side of the socket housing corresponding to at least one of a first surface and a second surface of the substrate, a plurality of socket contacts, each of the socket contacts corresponding to a respective one of a plurality of electrical contacts arranged on the substrate, each of the socket contacts configured to electrically couple to the respective electrical contact, the socket contacts on each side arranged substantially in a plane, the plurality of electrical contacts applied to at least one of a first surface of the substrate and a second surface of the substrate opposite the first surface, the plurality of electrical contacts arranged on an edge of the at least one of the first surface and the second surface; and an actuator configured to increase a normal force between the plurality of socket contacts and the plurality of electrical contacts;

wherein at least one socket contact includes:

a movable socket part including at least one first bump; and a spring contact including at least one second bump, each of the second bumps corresponding to a respective one of the first bumps, each corresponding pair of first and second bumps configured to urge against each other to increase the normal force in accordance with actuation of the actuator.

11. The device according to claim 10, wherein the substrate is receivable in the socket housing with a substantially zero insertion force.

12. The device according to claim 10, wherein the socket housing includes two socket contacts.

13. The device according to claim 10, wherein the socket housing further includes:

a first socket contact configured to electrically couple to a first electrical contact arranged on the first surface of the substrate when the substrate is received in the socket housing; and a second socket contact in an opposed parallel relationship with the first socket contact and configured to electrically couple to a second electrical contact arranged on the second surface of the substrate when the substrate is received in the socket housing.

14. The device according to claim 10, further comprising at least one spring device configured to urge each corresponding pair of first and second bumps against each other to thereby increase the normal force in accordance with actuation of the actuator.

15. The device according to claim 10, wherein the first and second bumps are adapted by size and configuration so that each corresponding pair of first and second bumps is urged against each other to thereby increase the normal force by a relative movement between the movable socket part and the spring contact in accordance with actuation of the actuator.

16. The device according to claim 15, wherein:

each of the bumps includes a sloped edge; and the bumps are arranged in a zig-zag pattern in a rest position and are aligned in an actuated position.

17. A method of creating a power connection, comprising:

inserting a substrate into a socket housing, the socket housing including, on each side of the socket housing corresponding to at least one of a first surface and a second surface of the substrate, a plurality of socket contacts, each of the socket contacts corresponding to a respective one of a plurality of electrical contacts arranged on the substrate and arranged substantially in a plane, and an actuator, the substrate including:

a first surface;

a second surface opposite the first surface; and the plurality of electrical contacts applied to at least one of the first surface and the second surface on an edge of the at least one of the first surface and the second surface, the plurality of electrical contacts configured to electrically couple to the plurality of socket contacts when the substrate is inserted into the socket housing; and actuating the actuator to increase a normal force between the plurality of socket contacts and the plurality of electrical contacts;

wherein at least one socket contact includes:

a movable socket part including at least one first bump; and a spring contact including at least one second bump, each of the second bumps corresponding to a respective one of the first bumps, each corresponding pair of first and second bumps configured to urge against each other to increase the normal force in accordance with actuation of the actuator.

18. The method according to claim 17, wherein the substrate is inserted into the socket housing with a substantially zero insertion force.

19. The method according to claim 17, wherein each corresponding pair of first and second bumps are urged against each other by at least one spring device when the actuator is actuated.

20. The method according to claim 17, wherein each corresponding pair of first and second bumps are urged against each other to thereby increase the normal force by a relative movement of the movable socket part and the spring contact in conjunction with the size and configuration of the bumps when the actuator is actuated.

21. The method according to claim 20, wherein:

each of the bumps includes a sloped edge; and the bumps are arranged in a zig-zag pattern in a rest position and are aligned in an actuated position.

22. A device, comprising:

a socket housing including at least one socket contact, the socket housing adapted to receive an edge-type substrate to electrically couple the at least one socket contact and at least one electrical contact applied to at least one of a first surface of the edge-type substrate and a second surface of the edge-type substrate opposite the first surface; and an actuator configured to increase a normal force between the at least one socket contact and the at least one electrical contact, the actuator including a lever configured to be pressed in a direction of the substrate to increase the normal force;

wherein at least one socket contact includes:

a movable socket part including at least one first bump; and a spring contact including at least one second bump, each of the second bumps corresponding to a respective one of the first bumps, each corresponding pair of first and second bumps configured to urge against each other to increase the normal force in accordance with actuation of the actuator.

* * * * *